US005718602A

United States Patent [19]

Savoca

[11] Patent Number: 5,718,602

[45] Date of Patent: Feb. 17, 1998

[54] SUSPENSION CONNECTOR ASSEMBLY FOR MULTIPLE PIN ELECTRICAL CONNECTOR

[75] Inventor: Paul F. Savoca, West Bay Shore, N.Y.

[73] Assignee: Duraline, A Division Of J.B. Nottingham Co., Inc., Central Islip, N.Y.

[21] Appl. No.: 687,784

[22] Filed: Jul. 31, 1996

[51] Int. Cl.[6] ..... H01R 13/00

[52] U.S. Cl. ..... 439/477; 362/403; 439/372

[58] Field of Search ..... 439/477, 378, 439/379, 380, 247, 248, 372; 362/403

[56] References Cited

U.S. PATENT DOCUMENTS

| | | | |
|---|---|---|---|
| 5,383,790 | 1/1995 | Kerek et al. | 439/248 |
| 5,393,245 | 2/1995 | Hinds, Jr. | 439/477 |

OTHER PUBLICATIONS

Brochure/Advertisement For Lighting & Lowering Systems, Model SCU-1A Dated 10/93.

Brochure/Advertisement For Lighting & Lowering Systems, Model SCU-2A Dated 10/93.

Brochure/Advertisement For Lighting & Lowering Systems, Model SCU-2X Dated 11/93.

Brochure for Lowering Systems, Inc.

Brochure/Advertisement for Design HMSP, Section 300, Page 11.

Brochure/Advertisement For Lighting & Lowering Systems, "How It Works", Dated 01/94.

Brochure/Advertisement For Suspension Contact Units, Model SCU-1.

*Primary Examiner*—Gary F. Paumen

*Assistant Examiner*—Tho D. Ta

*Attorney, Agent, or Firm*—Sixbey Friedman Leedom & Ferguson; Thomas W. Cole

[57] ABSTRACT

An improved suspension connector assembly is provided that is particularly adapted for use with a multiple pin and barrel type electrical connector. The suspension connector assembly includes a female connector mounted within a stationary housing, a movable male connector adapted to be raised and lowered toward and away from the female connector via the cable of a hoisting mechanism, and a latching mechanism for latching and unlatching the male connector to the female connector when the two are mutually engaged for a latching stroke distance. A resilient mounting assembly interconnects the female connector with the stationary housing. The stroke of the resilient mounting assembly is at least as long as the latching stroke distance of the latching mechanism so that the pins and barrels of the male and female electrical connectors will not be partially pulled apart from one another as a result of the stroke of the latching mechanism.

15 Claims, 6 Drawing Sheets

SUSPENSION CONNECTOR ASSEMBLY FOR MULTIPLE PIN ELECTRICAL CONNECTOR

BACKGROUND OF THE INVENTION

This invention generally relates to suspension connector assemblies of the type used, inter alia, in mast-supported street lighting systems, and is specifically concerned with an improved suspension connector assembly that is compatible for use with multiple pin and barrel electrical connectors.

Suspension connectors for mast-supported street lights are well known in the prior art. Such connectors allow the bulbs of the street light to be changed without the need for a cherry-picker truck to lift a man to the top of the support mast. Such connectors generally comprise a female, spring clip electrical connector mounted within a bell-shaped housing which in turn is secured onto the arm of the support mast. The street lights are screwed into a fixture having a prong-type male electrical connector. The light fixture and male connector may be lifted and lowered with respect to the female connector by means of a cable connected to a hand-cranked winch located at the base of the mast. A latching mechanism is provided between the male and female connectors for latching and unlatching them whenever the male connector is forcefully engaged against the female connector for a predetermined distance (referred to hereinafter as the latching stroke distance).

When it becomes necessary to change a burned-out bulb or to perform some other maintenance operation on the light fixture, the system operator first obtains access to the winch (which is usually stored within a hollow section of the mast). The winch is then cranked so that the cable forcefully engages the male connector against the female connector. Such an action unlatches the cam-operated latching mechanism. The operator then unwinds the reel of the winch. The weight of the light fixture and male connector is greater than the frictional force between the prongs of the male connector and the blade-type receivers of the female connector. Consequently, the male connector and light fixture will disengage from the female connector. The operator can then gently lower the male connector and light fixture by unreeling the cable of the winch. After the light fixture has been lowered to a convenient height, the bulb replacement or other maintenance operation is performed. The light fixture and male connector are then raised via the cable of the hoisting mechanism both to reengage the male and female connectors and to relatch the latching mechanism.

While such prior art suspension connectors work well in lighting systems, the inventor has observed that they are not well adapted for use with a mast-supported device requiring relatively complex, multiple-pin electrical connections, such as surveillance video cameras. When such connectors are used in lighting systems, the structure of the connectors may be relatively simple, since their sole function is to conduct electrical power to the light bulbs screwed into the lighting fixture. Hence the spring clip and prong structure of the connectors used in the prior art reliably conducts electricity despite the relative movement between the male and female connectors incident to the latching and unlatching operation.

However, the inventor has observed that if one attempts to use such clip and prong-type connectors to conduct information-carrying electrical current to electrical devices (such as surveillance video cameras) that require a large number of terminals, several problems arise. First, in view of the relatively large amount of space that the prongs and spring clips of such connectors require, there is only room for about six such connectors within the housing of prior art suspension connector assemblies. By contrast, electrical devices such as video surveillance cameras may require 20 such connectors in order to route information-carrying current to the various servo-motors that manipulate the orientation of the camera and the movement of the zoom lenses and other components. Secondly, the conduction of electricity through clip and prong-type connectors is often occasioned by some degree of arcing due to corrosion, wear, and other irregularities in the contact surfaces. While small amounts of arcing do not significantly interfere with the conduction of electrical power to devices such as street lights, it can seriously interfere with the informational content superimposed over the electrical current conducted to a surveillance camera or other sophisticated device.

While pin and barrel type electrical connectors are usually used to conduct electricity to surveillance video cameras for both informational and power purposes, such connectors are not compatible for use with conventional suspension connector assemblies, since the operation of the latching mechanism would cause the pins of the male connector to partially pull out of the barrels of the female connector at the end of the latching stroke, thus seriously jeopardizing the integrity oft he electrical connection.

Clearly, there is a need for an improved suspension connector assembly that is compatible for use with pin and barrel type connectors. Ideally, such a suspension connector assembly would also be compatible with the hoisting and latching mechanisms used in prior art suspension connector assemblies in order to minimize the need for the design and manufacture of new mechanical components.

SUMMARY OF THE INVENTION

Broadly speaking, the invention is an improved suspension connector assembly capable of reliably interconnecting a plurality of connector pins and barrels without the shortcomings associated with the prior art. The suspension connector assembly of the invention includes a female connector mounted within a stationary, bell-shaped housing, a movable male connector adapted to be raised and lowered toward and away from the female connector via a hoisting cable, a latching mechanism for latching and unlatching the male connector to and from the female connector, and a resilient mounting assembly for mounting the female connector within the interior of the housing. The mounting assembly includes one or more coil springs whose resiliency stroke is at least as long as the stroke distance required by the latching mechanism to latch and unlatch the male connector from the female connector. Additionally, the stiffness of the springs used in the mounting assembly is greater than the amount of force needed to completely insert the connector pins into their respective barrels. Hence, when the cable of the hoisting mechanism begins to push the connector pins of the male connector into the connector barrels of the female connector, the pins and barrels will become fully mated before the compression springs of the assembly become fully compressed. Because the resiliency stroke of the springs of the mounting assembly is greater than the stroke necessary for the latching mechanism to operate, the pins will not become partially withdrawn from their respective barrels at the completion of the latching stroke.

In the preferred embodiment, the resilient mounting assembly includes a pair of guide rods connected to a support plate which is mounted within the bell-shaped housing. The guide rods are slidably movable within guide sleeves disposed within bores present in the female connector. The aforementioned compression springs are concentrically disposed around the guide rods, and are compressed on one end by a top edge of a guide sleeve, and on the other end by the base plate. The resilient mounting assembly may further include a pair of retaining screws which not only retain the female connector to the base plate, but further define the stroke of the mounting assembly. In the preferred embodiment, the ends of the retaining screws are mounted on the base plate, while the heads are disposed within (and slidably movable within) bores present in the female connector. Retaining sleeves concentrically disposed at the top ends of the retaining bores prevent the heads of the retaining screws from being pulled out of the bores, thereby retaining the female connector to the support plate.

The bell-shaped housing of the suspension connector assembly may have a lower portion for covering the connector pins of the male connector when the pins initially engage the barrels of the female connector so that the pins are not exposed to ambient weather conditions at the time they begin to carry current. Finally, the suspension connector assembly of the invention may include an alignment mechanism for accurately registering the pins of the male connector with the barrels of the female connector prior to engagement.

BRIEF DESCRIPTION OF THE SEVERAL FIGURES

Figure 3A:
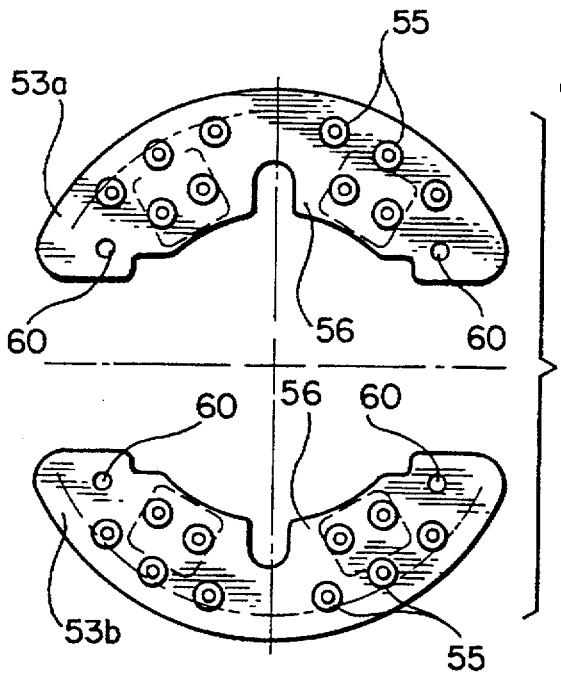
Figure 4A:
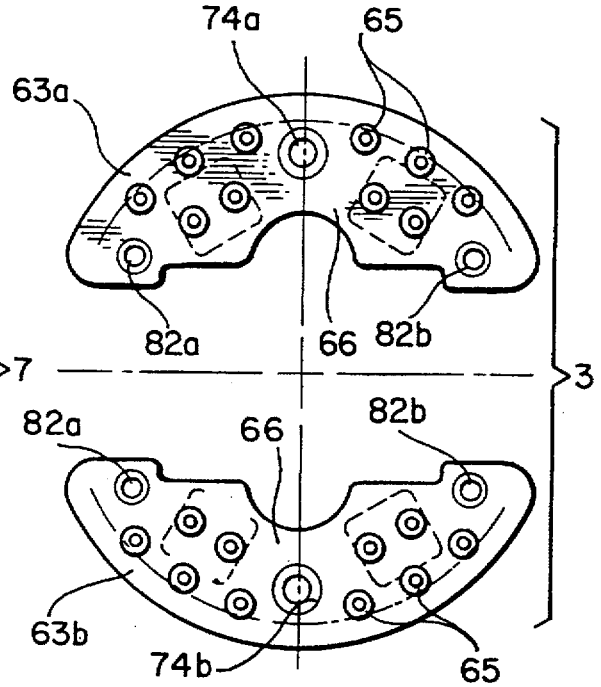
Figure 3B:
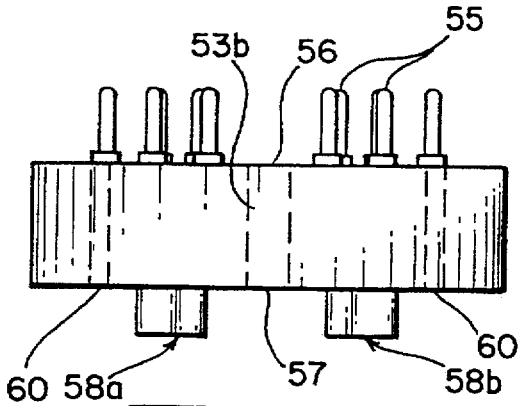
Figure 4B:
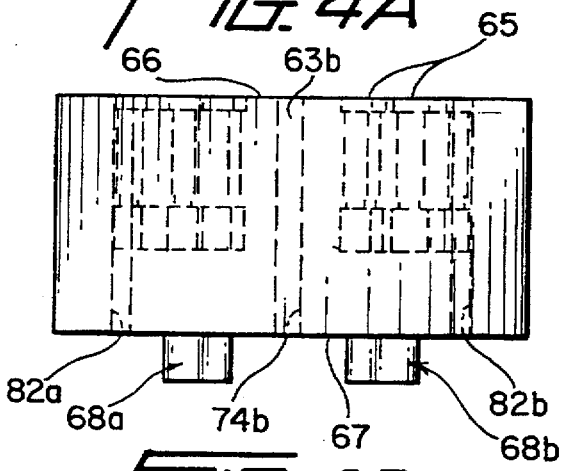
Figure 3C:
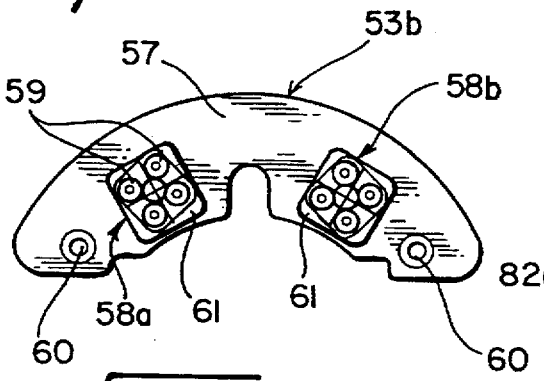
Figure 4C:
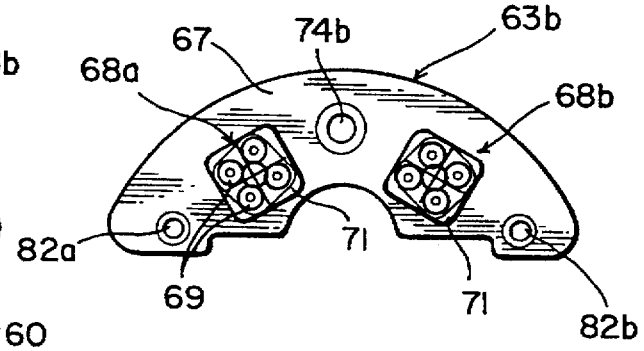
Figure 5:
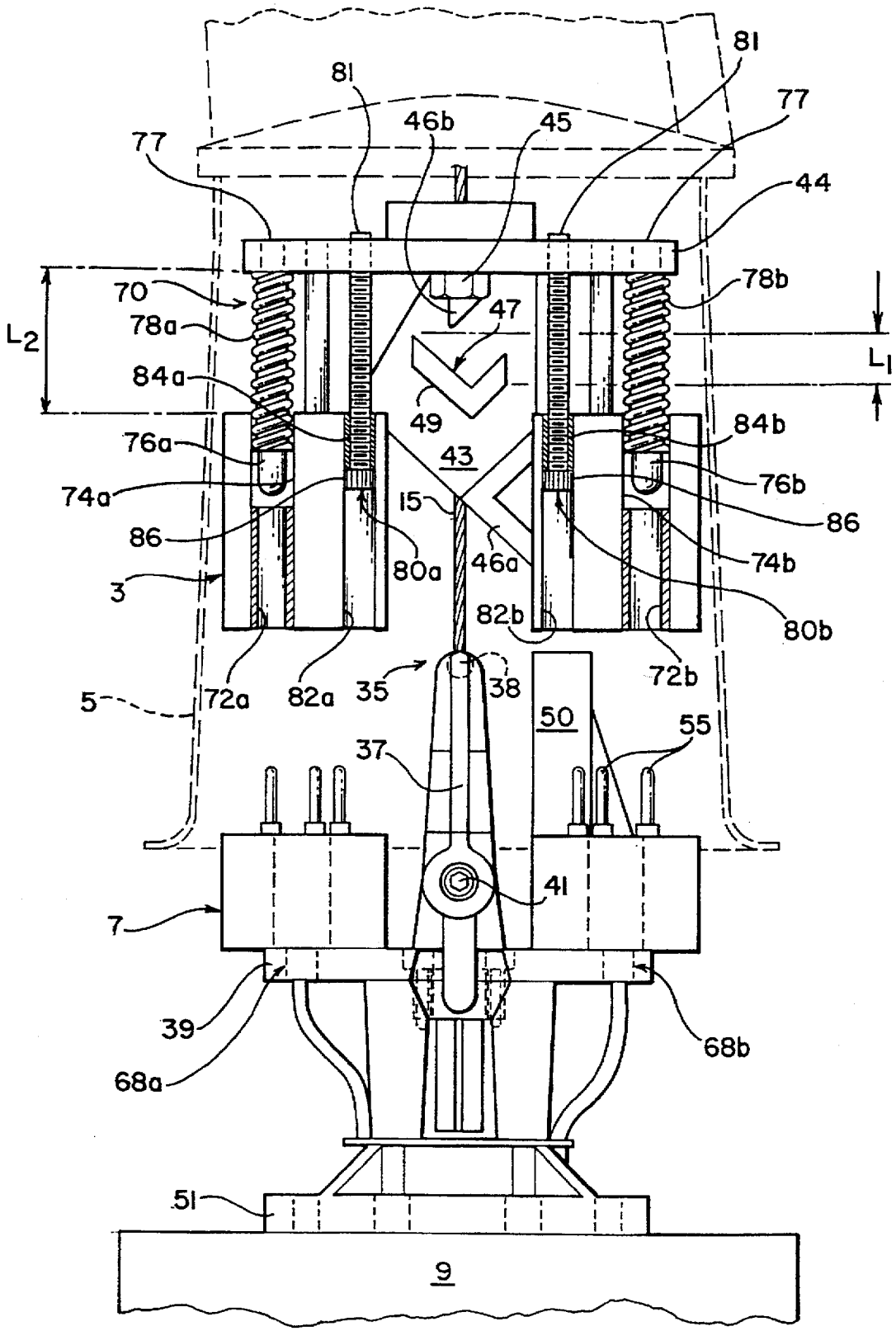
Figure 6:
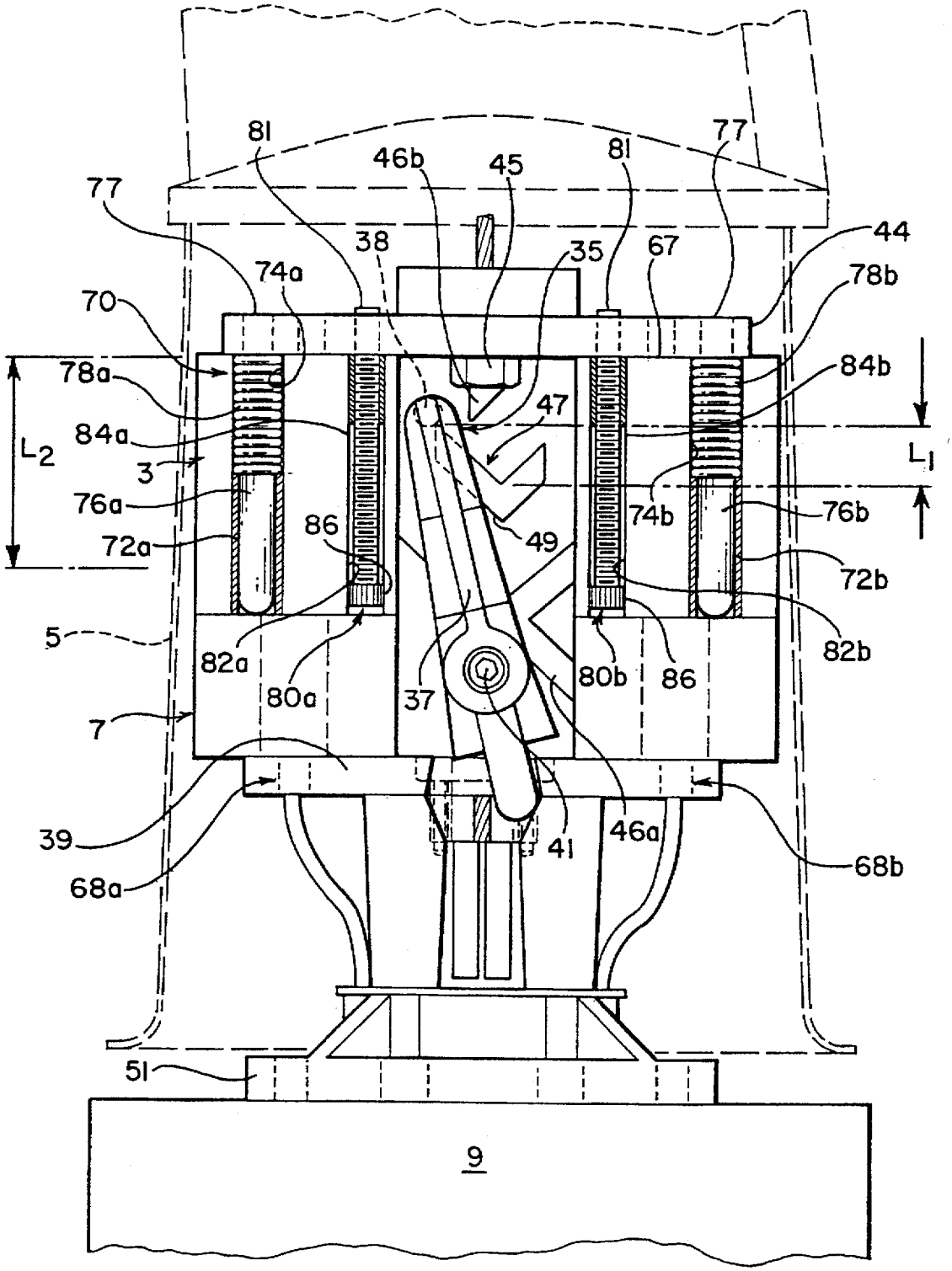
Figure 7:
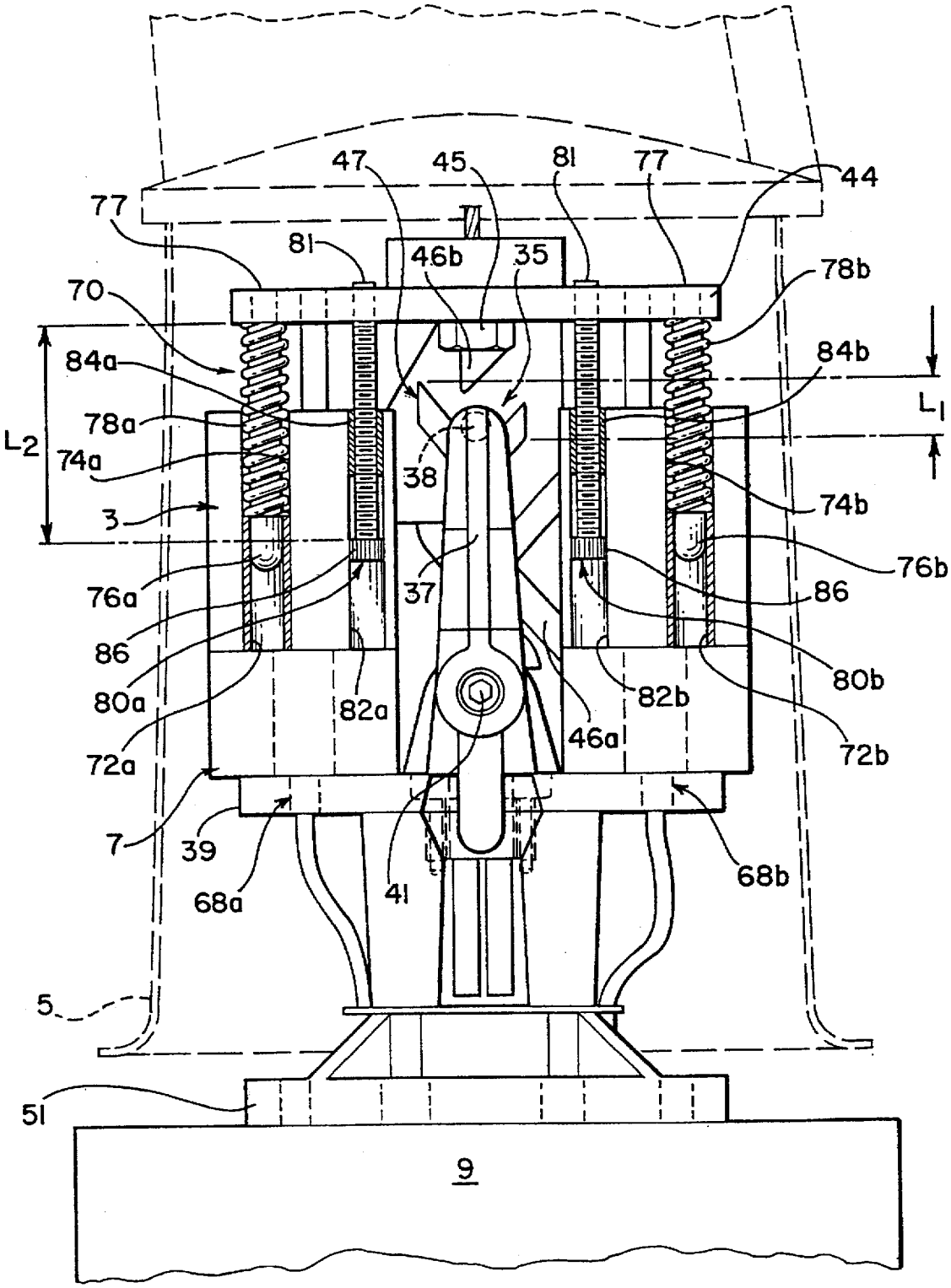

FIGS. 3A, 3B, and 3C are a front plan view, a side view, and a back plan view of the male connector of the assembly, respectively;

FIGS. 4A, 4B, and 4C are a front plan view, a side view, and a back plan view of the female connector of the assembly, respectively;

FIG. 5 is a side cross-sectional view of the male connector of the assembly being pulled into engagement with the female connector;

FIG. 6 is a side cross-sectional view of the male connector in engagement with the female connector of the assembly illustrating the length of the stroke necessary for the latching mechanism to secure these components together, and FIG. 7 is a partial, cross-sectional side view of the connector assembly after the latching mechanism has been actuated into a latching position.

DETAILED DESCRIPTION OF THE PREFERRED EMBODIMENT

Figure 1:
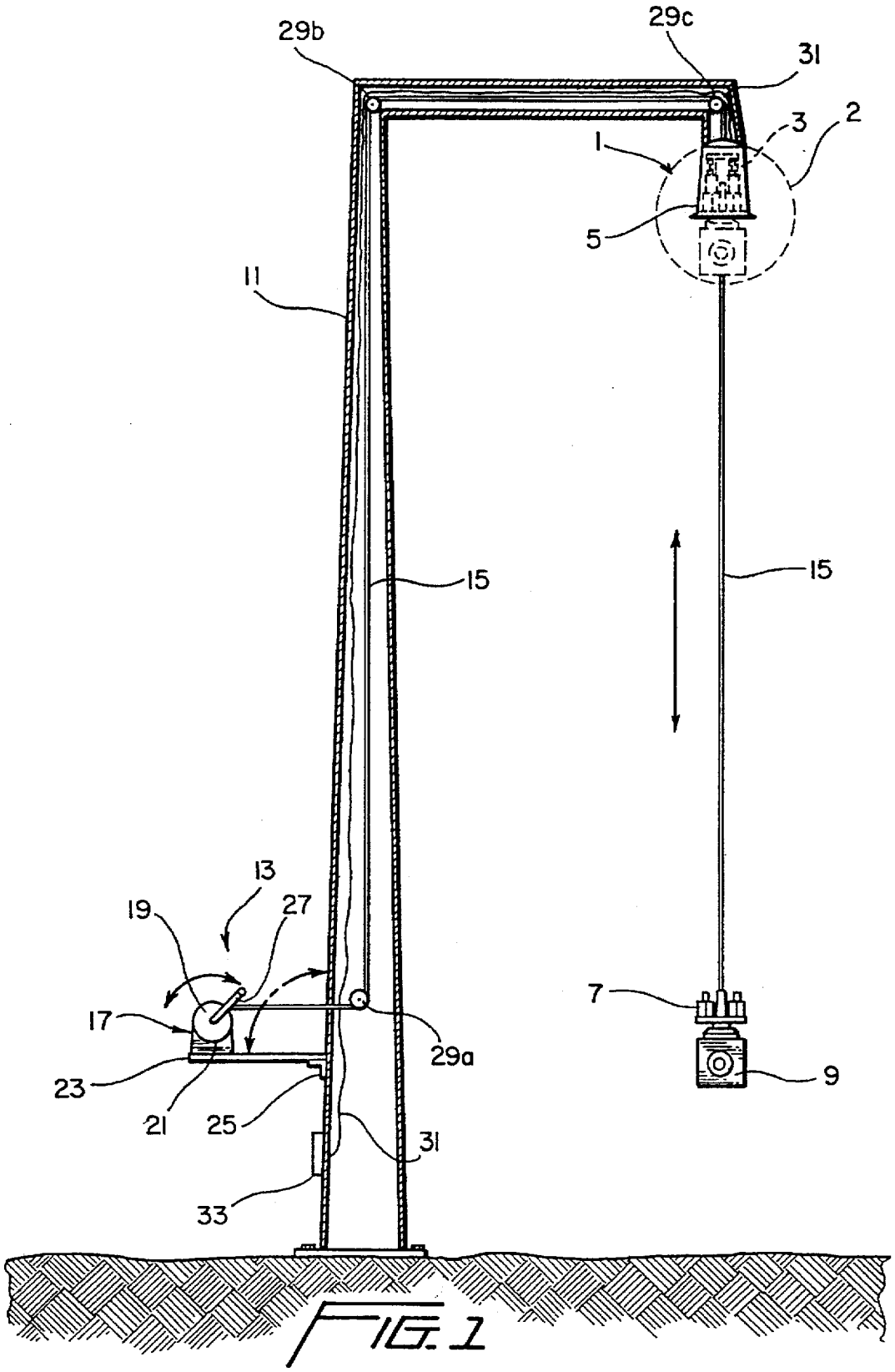
FIG. 1 is a cross-sectional side view of the improved suspension connector assembly of the invention in combination with a mast and hoisting mechanism.
Figure 2:
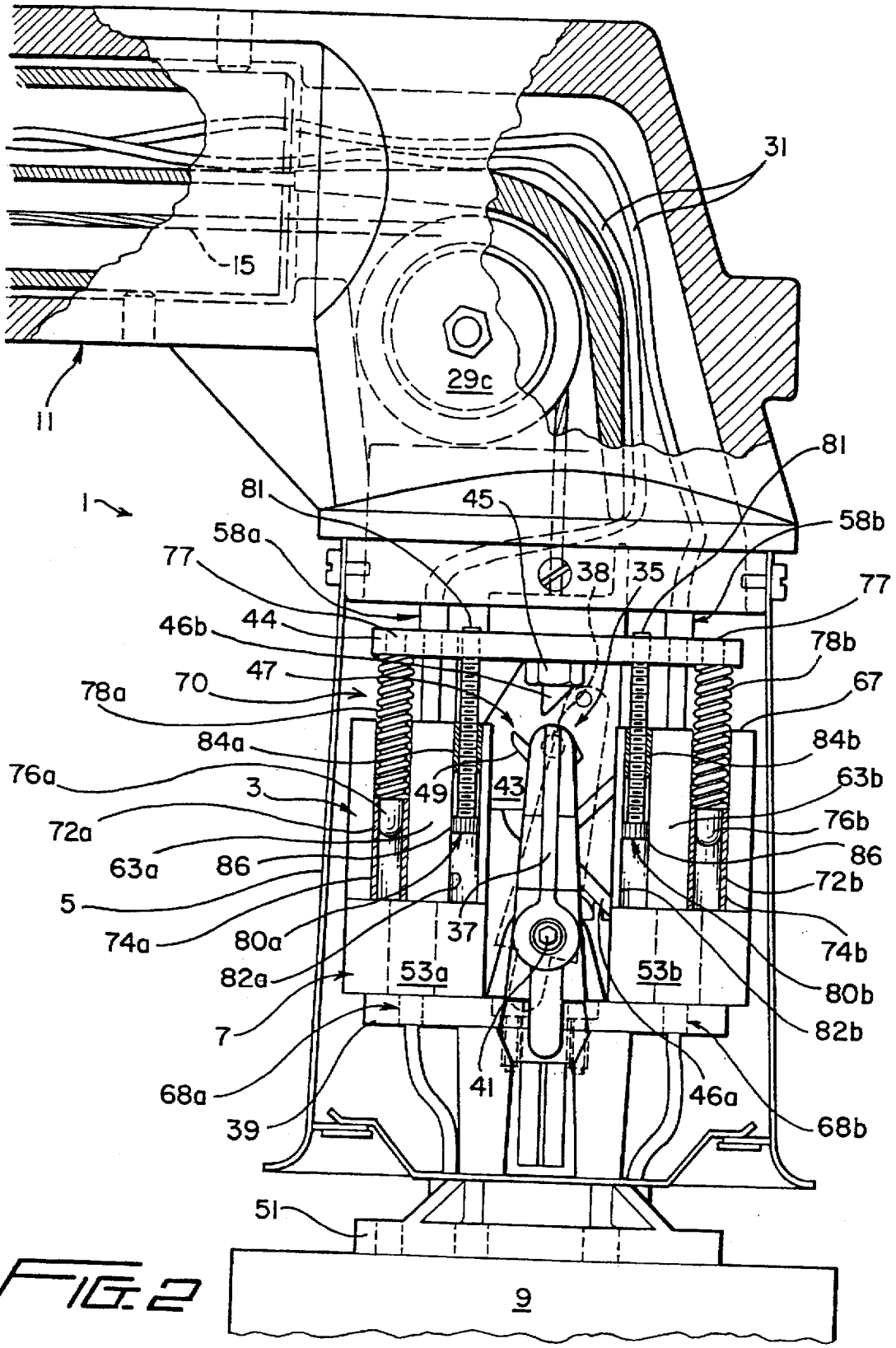
FIG. 2 is an enlargement of the improved suspension connector assembly illustrated in FIG. 1 with the male connector winched into engagement with the female connector.

With reference to FIGS. 1 and 2, wherein like numerals designate like components throughout all of the several figures, the improved suspension connector assembly 1 generally comprises a female connector 3 mounted at the top end of a stationary, bell-shaped housing 5, and a movable male connector 7. The connector assembly 1 of the invention is particularly adapted for use with an electronic device such as a surveillance camera 9 that requires a multiple pin and barrel-type connector for conducting multiple, information carrying electrical currents. As is best seen with respect to FIG. 1, the connector assembly 1 is supported by the arm of a mast 11.

A hoisting mechanism 13 allows the surveillance camera 9 and the movable male connector 7 to be raised into a working position (illustrated in phantom) or lowered near the ground to an access position which allows the system operator to perform a maintenance operation. To this end, the hoisting mechanism 13 includes a cable 15 that is connected on one end to the male connector 7, and at the other end to a winch 17. The winch 17 is conventional in structure, having a reel 19 rotatably mounted between a pair of lugs 21 secured onto a base plate 23 for winding and unwinding the cable 15. The base plate 23 is in turn pivotally connected onto a lower wall of the mast 11 by way of a hinge 25. The hinge 25 allows the winch 17 to be pivoted upwardly from the horizontal position illustrated in FIG. 1 to a storage position within the interior of the mast 11 (whereupon the base plate 23 becomes part of the lower walls of the mast 11). A crank 27 secured to the rotatably mounted reel 19 allows a system operator to wind the combination of the surveillance camera 9 and male connector 7 to either of the two positions illustrated in FIG. 1, while guide rollers 29*a–c* allow the cable 15 to be extended and withdrawn through the hollow interior of the mast 11 with a minimum amount of friction. A pair of control cables 31 interconnects the female connector 3 with an electrical outlet 33 mounted at the base of the mast 11. Each of these cables 31 may include ten or more separate electrical wires. Outlet 33 is in turn interconnected to control circuitry (not shown) which generates the electrical signals and currents necessary to actuate a plurality of focusing and positioning devices (likewise not shown) in the surveillance -camera 9.

With reference now to FIGS. 2 and 5, a latching mechanism 35 is provided for mechanically connecting and disconnecting the male connector 7 and the female connector 3. Mechanism 35 includes an elongated latch member 37 having a retaining pin 38 at its distal end. Latch member 37 is pivotally mounted onto a male connector support plate 39 by way of a bolt 41 and a lug (not shown). A latch plate 43 is secured to a support plate 44 that also supports the female connector 3. A mounting bolt 45 secures the female connector support plate 44 to the upper end of the bell-shaped housing 5. Plate 43 includes lower and upper ramp-shaped cams 46*a,b* for pivotally moving the latch member 37 into latching and unlatching positions, respectively, in a manner which will be described in more detail hereinafter. Plate 43 further includes a latch retainer 47 that also has a cam surface 49 that cooperates with the retaining pin 38 to pivot the latch member 37 into a latching position. Finally, the latching mechanism 35 includes an alignment member 50 (indicated in FIG. 5) which not only serves to properly align the latch member 37 with the plate 43, but also registers the pins 55 of the male connector 7 with the barrels 65 of the female connector 3 when the combination of the male connector 3 and surveillance camera 9 are pulled upwardly from the position illustrated in FIG. 5 to that illustrated in FIG. 2. In the preferred embodiment, the latching mechanism 35 is the same mechanism used in the Model No. SCU-2A suspension connector manufactured by Lighting And Lowering Systems, located in Chicago, Ill.

FIGS. 3A, 3B, and 3C illustrate the details of the male connector 7. Male connector 7 is ultimately connected to surveillance camera 9 by bracket 51. Connector 7 comprises a pair of generally semicircular body member 53*a,b*, each of which is preferably molded from a water, weather, and ozone resistant synthetic rubber, such as chlorosulfonated polyethylene. A synthetic rubber sold under the trademark Hypalon® is an example of such a synthetic rubber. A plurality of connector pins 55 project outwardly from the top faces 56 of each of the semi-circular body members 53*a,b*. The base portions of the connector pins (not shown) are secured into their respective body members 53*a,b* by molding them therein. The exposed part of each of the connector pins 55 is preferably gold or silver plated in order to enhance both corrosion resistance and conductivity. The lower face 57 of each of the body members 53*a,b* includes a pair of cables 58*a,b*, which are electrically connected to the base portions of the connector pins 55. Each of the these cables 58*a,b* constitutes a bundle of insulated wires 59, each of which is connected to a particular one of the pins 55. In the preferred embodiment, each of the semicircular body members 53*a,b* includes ten connector pins 55, and each of the cables 58*a,b* comprises a bundle of five wires 59 circumscribed by a resilient sleeve 61 of synthetic rubber for stain relief. Screw holes 60 allow semicircular body members 53*a,b* to be secured onto plate 39.

The female connector 3 illustrated in FIGS. 4A, 4B, and 4C is similar in construction to the previously described male connector 7, in that it comprises a pair of semicircular body members 63*a,b* formed from the same water, weather, and ozone resistant synthetic rubber that forms the body member 53*a,b* of the male connector. Each of the semicircular body members 63*a,b* of the female connector 3 includes a set of connector barrels 65 installed along its upper face 66. The connector barrels 65 are arranged in the same pattern as the pins 55 of the male connector 7 in order to be matable therewith. Each of the barrels 65 is formed from copper which may be silver or gold plated in order to enhance both corrosion resistance and conductivity. While not specifically shown in the drawing, each of the connector barrels 65 contains a slotted sleeve for resiliently gripping a connector pin. Each of the barrels 65 is further molded into the synthetic rubber that forms the body members 63*a,b* of the female connector 3. Projecting from the lower face 67 of each of the body members 63*a,b* are a pair of cables 68*a,b* as is best seen in FIG. 4C. Each of the cables 68*a,b* comprises five separate insulated wires 69, each of which is individually connected to one of the connector barrels 65 that is likewise molded into the body member 63*a,b*. In the preferred embodiment, the cables 68*a,b* are circumscribed by a sleeve 71 of synthetic rubber for strain relief.

Each of the body members 63*a,b* of the female connector 3 is provided with guide sleeves 72*a,b* disposed in sleeve bores 74*a,b* as shown. These sleeves 72*a,b* receive guide rods 76*a,b* that project downwardly from the previously discussed female connector support plate 44 (as shown in FIG. 2). Guide rods 76*a,b* each have threaded ends 77 screwed into support plate 44. With reference again to FIG. 2, biasing springs 78*a,b* are coiled around the guide rod 76*a,b*. Both of these springs 78*a,b* are maintained in a constant state of compression, with one end pushing against the female connector support plate 44, and the other end pushing against the top edge of the guide sleeves 72*a,b*. Retaining screws 80*a,b* are provided to slidably interconnect the body member 63*a,b* of the female connector 3 to the female connector support plate 44. One end 81 of each of the retaining screws 80*a,b* is screwed into the support plate 44 as shown, while the rest of the threaded shank of each screw is slidably disposed within a bore 82*a,b* provided within each of the semicircular body members 63*a,b* of the female connector 3. Retaining sleeves 84*a,b* are disposed in the screw bores 82*a,b* flush with the surface 67 of each of the body members 63*a,b*. The retaining sleeves 84*a,b* are dimensioned so as to slidably conduct the threaded shanks of the retaining screws 80*a,b*, but not the heads 86 thereof.

With reference now to FIGS. 1 and 2, when the maintenance operator wishes to lower the surveillance camera 9 into the position illustrated in FIG. 1 to perform a maintenance operation, he begins by pivotally moving the winch 17 into the working position illustrated in FIG. 1. Next, he turns the crank 27 of the reel 19 so that the cable 15 pushes the face 67 of the body member 63 of the female connector 3 flush with the bottom surface of the support plate 44. When this occurs, the retaining pin 38 of the latch member 37 slidably engages against upper cam 46*b* thereby angularly turning the latch member 37 into the position illustrated in phantom in FIG. 2. The maintenance operator then reverses the direction of the crank 37, and begins to unwind the cable 15 from the reel 19. The male connector 7 and surveillance camera 9 begins to drop. Because the retaining pin 37 of the latch member 38 is now disposed to the right of the retainer 47, the retainer 47 offers no resistance to the lowering of the combination of the male connector 7 and the surveillance camera 9. Additionally, the weight of these two components is sufficient to disengage the connector pins 55 of the male connector 7 from the barrel 65 of the female connector 3 so that the combination of the components 7 and 9 is free to drop down into the position illustrated in FIG. 1. The maintenance operator then performs whatever service operation is necessary.

FIGS. 5, 6, and 7 illustrate the reconnection of the male connector to the female connector 3. To reconnect these components, the system operator turns the crank 27 of the hoisting mechanism 13 in the direction indicated by the arrow. As the male connector 7 begins to approach the female connector 3, the alignment member 50 slides into the alignment receiver (not shown) mounted with the two opposing female connector body members 63*a,b*. This action registers the pins 55 of the male connector 7 with the barrels 65 of the female connector 3. The system operator then continues to reel the cable 15 against the force of the biasing springs 78*a,b* until the faces 67 of each of the female body members 63*a,b* are flush against the lowermost face of the female connector support plate 44, as is illustrated in FIG. 6. At this juncture, the latch pin 38 will have engaged the bottommost cam surface 49 of the latch retainer 47, thereby pivoting the latch member 37 away from the retainer 47 so that the pin may be raised above it. Simultaneously, the lower cam 46*a* operates on another cam surface (not shown) of the latch member 37 in order to pivot the member 37 into a vertical position so that the pin 38 is disposed over the retainer 47. The system operator then backs off of the crank 27. The combined weight of the male connector 7 and surveillance camera 9, in combination with the biasing force applied by the springs 78*a,b* then returns the male connector into the position illustrated in FIG. 7, wherein the retaining pin 38 engages the latch retainer 47 and prevents further downward vertical movement.

It is critical to note that, in the operation of the latching mechanism 35, the male connector 7 is engaged against and then withdrawn from the female connector 3 in a reciprocating movement having a certain stroke length $L_1$ in order to latch and unlatch the member 37 from the retainer 47, and that the vertical stroke $L_2$ provided by the resilient mounting assembly 70 is longer than the latching stroke $L_1$. Such dimensioning allows the female connector 3 to "follow" the male connector 7 during the withdrawal portion of the reciprocating movement. Such a "following" motion prevents a partial withdrawal of the pins 55 of the male connector 7 from the barrels 65 of the female connector 3 during the latching and unlatching operation, which in turn could compromise the integrity of an electrical connection between the pins 55 and the barrels 65. Additionally, the stiffness of the biasing springs 78*a,b* is greater than the amount of force necessary to insert the male pins 55 into the barrels 65 of the female connector 3, which again helps to insure that a complete insertion of the pins 55 will occur within the barrel 65 during the engagement portion of the reciprocating movement.

While this invention has been described with respect to a particular preferred embodiment, various modifications, variations, and additions will become apparent to persons skilled in the art. All such additions, modifications, and variations are intended to be encompassed within the scope of this patent, which is limited only by the claims appended hereto.

What is claimed:

1. An improved suspension connector assembly of the type having a female connector mounted within a stationary housing, a movable male connector adapted to be raised and lowered toward and away from said female connector, and a latching mechanism for latching and unlatching said male connector to and from said female connector when said male connector is engaged against said female connector and then withdrawn from said female connector in a reciprocating movement having a latching stroke length (L1), wherein the improvement comprises:

a plurality of electrical connector pins on said male connector, and a plurality of connector barrels in said female connector registrable with said connector pins, said pins being insertable within said connector barrels when an engagement force is applied between said male and female connectors, and means for resiliently mounting said female connector to said housing for applying a biasing force to said female connector that is greater than said engagement force necessary to insert said pins into said barrels to insure such insertion during the engagement portion of said reciprocating movement, and having a resiliency stroke at least as long as said latching stroke length (L1) such that said resiliency stroke allows the female connector to follow the male connector and thus for preventing the withdrawal of said pins from said barrels during the latching operation of said latching mechanism.

2. The improved suspension connector assembly as defined in claim 1, wherein the improvement further comprises a housing portion for covering said pins of said male connector when said pins initially engage said barrels of said female connector.

3. The improved suspension connector assembly as defined in claim 1, wherein the improvement further comprises means for aligning said connector pins and barrels into registry when said male connector is raised into engagement with said female connector.

4. The improved suspension connector assembly as defined in claim 1, wherein said female connector includes a body, and said resilient means includes at least one spring connected between said housing and said female connector body.

5. The improved suspension connector assembly as defined in claim 4, wherein said resilient means further includes a guide rod mounted on one or the other of said housing and said connector body, and a guide sleeve for slidably receiving said guide rod that is likewise mounted on one or the other of said housing and said connector body.

6. The improved suspension connector assembly as defined in claim 5, wherein said spring is concentrically disposed around said guide rod.

7. The improved suspension connector assembly as defined in claim 6, wherein said resilient means further includes a means for adjusting the length of said resiliency stroke.

8. The improved suspension connector assembly as defined in claim 7, wherein said length adjusting means includes at least one adjustment screw slidably disposed within a bore provided in said female connector.

9. The improved suspension connector assembly as defined in claim 8, wherein said adjustment means further includes a retaining sleeve concentrically disposed within said bore for retaining a head of said adjustment screw.

10. An improved suspension connector assembly, comprising:

a female connector having a connector body mounted with a stationary housing, said connector body having a plurality of electrical connector barrels;

a movable male connector adapted to be raised and lowered toward and away from said female connector, said male connector having a plurality of electrical connector pins registrable with and insertable into said connector barrels of said female connector body when an engagement force is applied between said female and male connectors;

a latching mechanism for latching and unlatching said male connector to and from said female connector when said male connector is engaged against said female connector and then withdrawn from said female connector in a reciprocating movement having a latching stroke length (L1);

means for resiliently mounting said female connector to said housing, including a support plate secured within said housing for supporting the body of said female connector, and means for slidably and resiliently connecting said body of said female connector to said support plate, wherein said resilient mounting means applies a biasing force to said female connector that is greater than said engagement force necessary to insert said pins into said barrels to insure such insertion during the engagement portion of said reciprocating movement, and has a resiliency stroke at least as long as said latching stroke length (L1) such that said resiliency stroke allows the female connector to follow the male connector and thus for preventing the withdrawal of said pins from said barrels during the latching operation of said latching mechanism.

11. The improved suspension connector assembly as defined in claim 10, wherein said resilient mounting means further includes a biasing spring for biasing a slidable movement of said body of said female connector with said force that is greater than said engagement force.

12. The improved suspension connector assembly as defined in claim 10, further comprising means for aligning said pins of said male connector with said barrels of said female connector when said male connector initially engages against said female connector.

13. The improved suspension connector assembly as defined in claim 12, further comprising means for adjusting the length of said resiliency stroke of said resilient mounting means.

14. The improved suspension connector assembly as defined in claim 13, wherein said length adjusting means includes at least one adjustment screw slidably disposed within a bore provided in said female connector.

15. The improved suspension connector assembly as defined in claim 14, wherein said adjustment means further includes a retaining sleeve concentrically disposed within said bore for retaining a head of said adjustment screw.

* * * * *